United States Patent [19]

Strain

[11] 3,979,276

[45] Sept. 7, 1976

[54] SILICATE TREATED ASBESTOS DIAPHRAGMS FOR ELECTROLYTIC CELLS

[75] Inventor: Franklin Strain, Pittsburgh, Pa.

[73] Assignee: PPG Industries, Inc., Pittsburgh, Pa.

[22] Filed: Aug. 5, 1975

[21] Appl. No.: 602,174

Related U.S. Application Data

[62] Division of Ser. No. 468,844, May 10, 1974, which is a division of Ser. No. 343,600, March 21, 1973, Pat. No. 3,847,762.

[52] U.S. Cl. ..... 204/282; 204/295

[51] Int. Cl.[2] ..... C25B 13/06; C25C 7/02

[58] Field of Search ..... 204/295, 282

[56] References Cited

UNITED STATES PATENTS

| | | | |
|---|---|---|---|
| 578,073 | 3/1897 | Blumenberg | 204/295 |
| 984,915 | 2/1911 | Heltzen | 204/295 |
| 1,433,017 | 10/1922 | McKee | 204/282 |
| 3,374,164 | 3/1968 | Balej et al. | 204/282 |

*Primary Examiner*—R. L. Andrews
*Attorney, Agent, or Firm*—Richard M. Goldman

[57] ABSTRACT

A diaphragm is disclosed for electrolytic cells, for example, chlor-alkali cells. The diaphragm is characterized in that it has been treated with a water-soluble silicate on the anolyte side. Also disclosed is an electrolytic cell process using such a diaphragm, and a method for preparing such a diaphragm.

8 Claims, No Drawings

SILICATE TREATED ASBESTOS DIAPHRAGMS FOR ELECTROLYTIC CELLS

This is a division of application Ser. No. 468,844, filed May 10, 1974, which was a division of application Ser. No. 343,600, filed Mar. 21, 1973, now U.S. Pat. No. 3,847,762.

BACKGROUND OF THE INVENTION

Diaphragm cells useful for the electrolysis of brines and the formation of chlorine and caustic soda have an anolyte chamber and a catholyte chamber. The anolyte chamber contains an anolyte solution containing sodium chloride at a pH of from about 2 to about 4.5. Within the anolyte chamber is an anode at which chlorine is evolved. The catholyte chamber contains catholyte liquor at a pH of from about 10 to about 12.5. The catholyte liquor contains sodium hydroxide, and sodium chloride. Sodium hydroxide generated in the catholyte and hydrogen gas is evolved at the cathode.

In the operation of the diaphragm cell, brine containing approximately 300 to 315 grams per liter of sodium chloride is fed into the anolyte At the anode, the reaction $2Cl^-$ $Cl_2+2e^-$ takes place.

The anolyte liquor passes from the anolyte chamber through the diaphragm into the catholyte chamber and a catholyte product containing from approximately 110 to about 130 grams per liter of sodium hydroxide and from approximately 110 to about 170 grams per liter of sodium chloride is formed. In the catholyte chamber, the reactions $Na^+ + OH^-$ NaOH, and $2H^+ + 2e^-$ $H_2$ takes place.

Typically, diaphragms for chlorine cells have been constructed of chrysotile asbestos. The chrysotile asbestos provides a diaphragm having a thickness of from about one-eighth of an inch to about one-fourth of an inch. Chrysotile asbestos diaphragms generally have a service life on the order of from about 4 to about 8 months, and most frequently about 6 months.

It is therefore necessary to periodically remove the diaphragm cell from service in order to remove the old diaphragms from the cathodes, and install new diaphragms on the cathodes. This periodic removal of the cell from service results in a consequent loss of production in order to carry out a labor intensive cell renewal operation. In the past, when diaphragm cells used graphite anodes, diaphragm renewal could be coordinated with anode renewal. However, metallic anodes, e.g., coated titanium anodes, have replaced such graphite anodes to a considerable degree. While graphite anodes have a life of from about 4 to about 8 months, the metallic anodes now being used have a life far in excess of 4 to 8 months, e.g., 3 or 4 or more years. Accordingly, the renewal of diaphragms has become a principal factor in cell outage.

SUMMARY OF THE INVENTION

It has now unexpectedly been found that a particularly long-lived diaphragm may be provided by a chrysotile asbestos diaphragm which has been treated with a water-soluble silicate on the anolyte side thereof. According to this invention, a conventional chrysotile asbestos diaphragm is treated with a water-soluble silicate which is rendered substantially insoluble during or after deposition thereby providing a tough, adherent, electrolyte permeable coating or sizing on the anolyte side thereof. Such a diaphragm has a long life, e.g., in excess of 6 months, and frequently in excess of 1 year of longer. Additionally, according to this invention, an asbestos diaphragm may be coated or sized with a water-soluble silicate several times over the course of its life thereby considerably extending the service life of a diaphragm.

DETAILED DESCRIPTION OF THE INVENTION

According to this invention, a diaphragm for chlor-alkali electrolytic cells is provided having a long service life. Such an asbestos diaphragm is one that has been treated with a water-soluble silicate on the anolyte side thereof.

According to one exemplification, the diaphragm is a deposited asbestos diaphragm. For example, the deposited asbestos may be chrysotile asbestos where the individual fibers have a fiber length of from about 0.25 inch to about 1.50 inch and a fiber diameter in the range of from about 0.015 microns to about 0.050 microns.

Additionally, fine asbestos powders, such as Union Carbide "Calidria" (T.M.) asbestos may be present with the asbestos fibers.

Typically, a deposited chrysotile asbestos diaphragm will have a weight of from about 0.2 pounds of asbestos per square foot of surface area to about 0.4 pounds of asbestos per square foot of exterior surface area.

According to another exemplification of this invention, the asbestos diaphragm may be an asbestos paper diaphragm having a thickness of from about 30 mils to about 60 mils and a weight of from about 30 grams of asbestos per square foot of exterior surface area to about 100 grams of asbestos per square foot of exterior surface area.

According to this invention, the anolyte-facing surface of the diaphragm is treated with a water-soluble silicate which is rendered substantially insoluble to acidic media during deposition or treatment to provide a strong, adherent, electrolyte-permeable fiber coating. While the preferred silicates are referred to herein as being soluble prior to treatment of or deposition on the asbestos, they are also characterized by their ability to form strong binders or sizes, adherent to asbestos. Water-soluble silicates are those silicates having the formula $(Me_2O)_m(SiO_2)_n$ where Me is an alkali metal and $m$ and $n$ are as described herein after. The alkali metals include lithium, sodium, potassium, rubidium, and cesium. Most frequently, Me is lithium, sodium or potassium. Lithium provides a particularly flexible tough, adherent coating on the asbestos. However, the voltage drop across a lithium silicate coated asbestos diaphragm is slightly higher than the voltage drop across an asbestos diaphragm having an equivalent amount of a sodium silicate or potassium silicate coating thereon.

Most frequently lithium, sodium, or potassium silicate will be the preferred water-soluble silicate. Generally, for reasons of cost, e.g., the cost of the silicate and electrical power costs, sodium silicate is preferred over either lithium silicate or potassium silicate. However, entirely satisfactory results may be obtained with either lithium silicate or potassium silicate.

The $SiO_2$ moiety may either be a mono-silicate, a poly-silicate or a poly-silicic acid. The formula for a water-soluble silicate, $(Me_2O)_m(SiO_2)_n$ does not refer to an actual structural formula of the silicate, but rather to the stoichiometry of the silicate. For example, the silicate may be sodium orthosilicate, $(Na_2O)_2.(SiO_2)$, sodium metasilicate, $(Na_2O)$ . $(SiO_2)$, or sodium polysilicate $(Na_2O) \cdot (SiO_2)_n$ where n is in the range of 2 to 4.

As a general rule, the greater the ratio of *n* to *m* (i.e., the smaller the ratio of *m* to *n*) the better the soluble silicate is for the use herein intended. As a general rule, however, the upper limit of the ratio of *n* to *m* (i.e., the lower limit of the ratio of *m* to *n*) is that level at which a solution ceases to form and the silicate no longer remains adhesive. The preferred silicates are those having a ratio of *n* to *m* below the level at which a solution ceases to form and the silicate loses its adhesion.

The silicate itself is a complex composition of silicate ions and radicals, poly-silicic acid ions and radicals, oxides and ions of the metal, water, and colloidal silica. The silicate ions and radicals may be present in the form of ions or colloidal silica. The colloidal silica may further be present in the form of hydrated micelles and non-hydrated micelles. As a general rule, micelle formation occurs when the ratio of *m* to *n* is less than one-quarter (i.e., when the ratio of *n* to *m* is greater than 4).

The preferred water-soluble silicates useful in providing the diaphragm of this invention are those wherein the ratio of *m* to *n* is less than 1 and preferably one-third or less. Particularly good results are obtained when the ratio of *m* to *n* is in the range of from about one-half to about one-fourth. Satisfactory results are also obtained when the ratio of *m* to *n* is even less than one-fifth, for example, as small as one-tenth or less.

According to this invention, the silicate is coated on the anolyte surface of the asbestos diaphragm. The amount of silicate present is from about 0.01 to about 5.0 grams per square foot of external surface area, generally in excess of 0.1 gram per square foot, and preferably from about 0.5 to about 2.0 grams per square foot.

Moreover, for any given porosity, pore size distribution, and thickness of diaphragm, best results are obtained if the silicate extends at least as far into the diaphragm from the anolyte surface as the "gel layer" in an untreated diaphragm of like porosity, pore size distribution, and thickness. This gel layer is described by Kircher, "Electrolysis of Brines in Diaphragm Cells," in Sconce, ed., *Chlorine*, A.C.S. Monograph Series, No. 154, Reinhold Publishing Co., New York (1962), at Page 105, as a layer "formed within the asbestos mat which is sensitive to pH and which tends to dissolve, precipitate and reform depending upon flow rate and salt content and pH of the flowing liquor."

Typically, the gel layer extends approximately 0.08 to about 0.12 inch into the diaphragm. Therefore, an optimal depth of penetration of the silicate is at least 0.08 inch, and preferably about 0.15 inch, or even to the full thickness of the diaphragm, especially when the diaphragm is less than about 0.15 inch thick.

According to this invention, a silicate treated asbestos diaphragm is provided that is useful for chlor-alkali diaphragm cell service where concentrated unsaturated brine, e.g., water containing from 250 to about 310 grams per liter of salt, or saturated brine, e.g., water containing in excess of 310 to 315 grams per liter of sodium chloride, is fed to an anolyte chamber of the cell and electrolyzed to form chlorine, hydrogen, and a liquid composition containing sodium chloride and sodium hydroxide. Within the anolyte chamber, sodium chloride is present as sodium ion and chloride ion. At the anode within the anolyte chamber the reaction $2Cl^- \rightarrow Cl_2 + 2e^-$ takes place. The anolyte liquor, including sodium chloride and sodium hydroxide, flows through the diaphragm under the driving force of a hydrostatic head of anolyte into the catholyte chamber. In the catholyte chamber, the reaction $Na^+ + OH^- \rightarrow NaOH$ takes place, while at the cathode within the catholyte chamber, the reaction $2H^+ + 2e^- \rightarrow H_2$ takes place. A cell liquor containing from about 100 grams per liter to about 135 grams per liter of sodium hydroxide and from about 160 grams per liter to about 200 grams per liter sodium chloride is obtained.

The diaphragms prepared according to this invention typically have a service life in excess of 8 months and frequently in excess of 1 year or even longer, compared with a service life of 4 to 6 months for conventional asbestos diaphragms.

According to another exemplification of this invention, a conventional asbestos diaphragm may be treated with a water-soluble silicate prior to or when actually showing signs of incipient deterioration. Typically, such treatment will consist of brushing, rolling, spraying, or pulling a water-soluble silicate onto and through the anolyte surface of the diaphragm to provide thereon a coating of water-soluble silicate of from about 0.01 to about 5.0 grams per square foot.

According to this invention, a diaphragm may be prepared having a silicate on the anolyte surface by first preparing an asbestos diaphragm in the conventional manner, and thereafter applying a solution of a water-soluble silicate to the diaphragm. Thus, a diaphragm may be prepared by dispersing from about 0.5 weight percent to from about 2.0 weight percent of chrysotile asbestos fibers in a cell liquor solution containing about 100 to 150 grams per liter of sodium hydroxide and about 150 to 225 grams per liter of sodium chloride, and aging the asbestos in the cell liquor for from approximately 1 day to about 5 days. Thereafter, the asbestos may be applied to a cathode structure in the conventional manner, e.g., by drawing a vacuum across the cathode and causing the asbestos fibers to be deposited on the cathode.

Thereafter, the water-soluble silicate may be applied to the asbestos diaphragm. A liquid composition of the water-soluble silicate in water may be prepared. Typically, the liquid composition should contain as much silicate as possible for effective coating or sizing of the surface layers of the asbestos diaphragm and binding of the fibers together, but still allowing adequate porosity for flow of the electrolyte through the diaphragm. For example, the liquid composition may contain from about 0.01 to about 5 weight percent of the water-soluble silicate in water, or even higher, for example, up to about 10 weight percent of the water-soluble silicate.

The solution may then be applied to the asbestos diaphragm by various methods. Thus, the solution containing the water-soluble silicate may be applied to the diaphragm by painting, brushing, spraying, or drawing the solution through the diaphragm.

According to one preferred exemplification of this invention, a small amount of air is drawn through the diaphragm while applying the water-soluble silicate. It is believed that this serves to maintain the porosity and electrolyte-permeability properties of the diaphragm.

According to still another exemplification of this invention, a diaphragm may be prepared by first preparing a dispersion of chrysotile asbestos in a dilute aqueous solution of a water-soluble silicate in water.

For example, a solution may be prepared containing 1 weight percent sodium silicate in water. Then sufficient chrysotile asbestos may be added to provide a dispersion containing approximately 1 to 2 weight percent of chrysotile asbestos. Thereafter, a cathode structure may be inserted in the liquid containing the asbestos in a dilute solution of water-soluble silicate and the asbestos and silicate caused to be deposited on the cathode structure.

After applying the silicate to the chrysotile asbestos diaphragm, the diaphragm may be treated to further set the silicate. This may be accomplished by drying and heating the diaphragm, e.g., to from about 80° C. to about 140° C. Alternatively the diaphragm may be exposed to acidic anolyte liquor. The exposure to acidic anolyte liquor appears to convert the water-soluble silicate into an amorphous, anolyte resistant, hydrated silica coating and bonding material. The amorphous hydrated silica appears to protect the asbestos fibers from the leaching action of the anolyte, i.e., the removal of magnesium from the asbestos, and from the erosive action of the turbulent chlorine containing anolyte.

The following examples are illustrative.

EXAMPLE I

A diaphragm having a silicate-treated anolyte surface was prepared and utilized in the electrolysis of brine.

The asbestos was drawn from a slurry of about 120 grams per liter of sodium hydroxide and about 150 grams per liter of sodium chloride, and 2 grams per liter of G.A.F. Grade H1-H2 chrysotile asbestos in water. The liquid composition of sodium hydroxide, sodium chloride, and asbestos had been aged for about 5 days at the time the diaphragm was drawn. The diaphragm was then heated to about 90° C. for 19.5 hours. The resulting asbestos diaphragm weight 0.50 pounds per square foot.

The cathode-diaphragm assembly was then treated with a sodium metasilicate solution. First the dried diaphragm was wetted with 30 grams of water per square foot. The sodium metasilicate solution containing 1 percent by weight sodium metasilicate in distilled water was applied to the diaphragm. The solution was brushed onto the asbestos diaphragm at the rate of 1 gram of silicate per square foot with air being pulled through the diaphragm while brushing.

Thereafter, the cathode and cathode chamber was joined to an anode chamber having a titanium mesh anode with a Bishop A-1 platinum coating.

An electrolyte containing 315 grams per liter of sodium chloride was fed to the cell and voltage was established across the cell. Chlorine was rapidly generated at the anode, and the pH of the anolyte solution rapidly dropped to pH 2–3. Thereafter, chlorine was recovered from the anolyte chamber, and hydrogen gas and a cell liquor product containing on a time average 160 to 180 grams per liter of sodium chloride and 100 to 130 grams per liter of sodium hyroxide was recovered from the catholyte chamber. The range of voltage drops across the diaphragm was calculated to be 0.53 to 0.78 volt with a range of voltage drops across the cell of 3.31 to 3.45 volts.

After 4 days of electrolysis, the hydrostatic head across the diaphragm was 6.1 inches of brine and the voltage across the cell was 3.31 volts. After 76 days of electrolysis, the cell voltage was 3.41 volts, and the hydrostatic head was 7,4 inches. At this point, the cell was shut down. The diaphragm was visually determined to be in satisfactory condition.

EXAMPLE II

Three diaphragms were subjected to side by side life testing in substantially identical cells under substantially identical conditions.

The cells each had a 35 cubic inch capacity catholyte chamber fabricated of θ inch by 1⅛ inch by 1⅛ inch angle iron with a 10 gauge steel back and a 35 square inch iron cathode. Each cell also had a 35 cubic inch capacity anolyte chamber fabricated of one-fourth inch PVDC with a 1 inch PVDC frame and a 35 square inch Bishop platinized titanium anode. The anodes were spaced one-eighth inch from the cathodes by "Neoprene" gaskets.

Three slurries were prepared. Each slurry contained 33.1 grams of Johns-Manville 4K-12 chrysotile asbestos, 5 grams of Solka-Floc alphacellulose, and 1600 milliliters of cell liquor of 12 weight percent sodium hydroxide and 12 weight percent sodium chloride. Each slurry was agitated for 30 minutes with a nitrogen stream and 20 minutes with an ultrasonic generator.

The individual diaphragms were deposited by inserting a cathode in the slurry and drawing the slurry through the cathode screen at a vacuum of one inch of mercury until the liquid appeared clear. The vacuum was then pulled to 10 inches of mercury, and subsequently to 17 inches of mercury and maintained at 17 inches of mercury for 20 minutes. The diaphragms were then dried in air for 7 days.

Run A

One diaphragm was subsequently utilized in an electrolytic cell without further treatment. After 14 days of electrolysis at 190 Amperes per square foot, and an anode cathode gap of one-eighth inch, the diaphragm failed. The average cell voltage was 3.14 volts.

Run B

The second diaphragm was coated with 28.3 milliliters of a one weight percent solution of sodium metasilicate by brushing and dried at 85° C. for 40 hours. After 73 days of electrolysis at 190 Amperes per square foot, and an anode-cathode gap of one-eighth inch, the current efficiency had dropped 4 percent, but no holes were observed. The average cell voltage was 3.29 volts.

Run C

The third diaphragm was coated with Lithium Corporation of America "Lithsil-S". Lithsil-S is a solution containing 1.9 weight percent $Li_2O$, 1.2 weight percent $Na_2O$, 18.9 weight percent $SiO_2$, and the balance water, and having a density of 1.187 grams per liter. The coating solution was obtained by diluting 18.9 milliliters of the Lithsil-S solution with 100 milliliters of water. Twenty-eight and three tenth milliliters (28.3 ml) of this solution were brushed onto the third diaphragm. After 27 days of electrolysis at 190 Amperes per square foot and an anode-cathode gap of one-eighth inch, the diaphragm failed. The average cell voltage was 3.95 volts.

EXAMPLE III

Sodium metasilicate was used to rejuvenate an asbestos diaphragm in a operational electrolytic cell.

The operational electrolytic cell had an asbestos diaphragm that had been pulled from an aqueous slurry of sodium hydroxide, sodium chloride, and 2 weight percent Johns-Manville 3T-4T asbestos. The diaphragm was used in an electrolytic cell having coated titanium anodes. After 23 days of electrolysis, the concentration of hydrogen in the chlorine gas increased to a high level indicating deterioration of the asbestos diaphragm. At this point 1 weight percent sodium metasilicate was added to the brine feed. The hydrogen content of the chlorine gas returned to normal and the cell voltage remained normal.

Although the present invention has been described with reference to specific details of particular embodiments thereof, it is not intended thereby to limit the scope of the invention except insofar as the specific details are recited in the appended claims.

I claim:

1. In a porous sodium chloride brine permeable fibrous chrysotile asbestos diaphragm, the improvement wherein said diaphragm has an amorphous, hydrated silica surface formed by depositing thereon to a depth of at least 0.08 inch from 0.01 to 5.0 grams per square foot of diaphragm area of a water soluble silicate having the empirical formula:

$$(Me_2O)_m(SiO_2)_n$$

where Me is chosen from the group consisting of lithium, sodium, and potassium, and the ratio of m to n is from about 1:1 to about 1:10, and thereafter contacting said diaphragm with aqueous acidic media.

2. The diaphragm of claim 1 wherein the silicate is chosen from the group consisting of metasilicates and polysilicates.

3. The diaphragm of claim 2 wherein the silicate is sodium polysilicate.

4. The diaphragm of claim 1 wherein there is in excess of 0.1 gram per square foot of silicate on the surface of the diaphragm.

5. In an electrolytic cell cathode structure comprising an electrolyte permeable, catholyte resistant metal member having in contact therewith one surface of a porous sodium chloride brine permeable fibrous chrysotile asbestos diaphragm, the improvement wherein the opposite surface of the diaphragm has an amorphous, hydrated silica coating formed by depositing thereon to a depth of at least 0.08 inch from 0.01 to 5.0 grams per square foot of diaphragm area of a water soluble silicate having the empirical formula:

$$(Me_2O)_m(SiO_2)_n$$

where Me is chosen from the group consisting of lithium, sodium, and potassium, and the ratio of m to n is from about 1:1 to about 1:10, and thereafter contacting said diaphragm with aqueous acidic media.

6. The cathode structure of claim 5 wherein the silicate is chosen from the group consisting of metasilicates and polysilicates.

7. The cathode structure of claim 6 wherein the silicate is sodium polysilicate.

8. The cathode structure of claim 5 wherein the diaphragm comprises more than 0.1 gram per square foot of silicate.

* * * * *